US010618609B1

(12) United States Patent
Ferris

(10) Patent No.: US 10,618,609 B1
(45) Date of Patent: Apr. 14, 2020

(54) TRI-HULL FISHING KAYAK WITH ELEVATED SEAT AND FOOT-OPERATED PADDLES

(71) Applicant: Gregory M. Ferris, Muscatine, IA (US)

(72) Inventor: Gregory M. Ferris, Muscatine, IA (US)

( * ) Notice: Subject to any disclaimer, the term of this patent is extended or adjusted under 35 U.S.C. 154(b) by 0 days.

(21) Appl. No.: 16/295,308

(22) Filed: Mar. 7, 2019

(51) Int. Cl.

| | |
|---|---|
| ***B63B 34/20*** | (2020.01) |
| ***B63B 1/12*** | (2006.01) |
| ***B63H 16/18*** | (2006.01) |
| ***B63H 20/00*** | (2006.01) |
| *B63B 34/26* | (2020.01) |

(52) U.S. Cl.
CPC ..... *B63B 34/20* (2020.02); *B63B 1/125* (2013.01); *B63H 16/18* (2013.01); *B63H 20/007* (2013.01); *B63B 34/26* (2020.02)

(58) Field of Classification Search
CPC ..... B63B 34/20; B63B 34/26; B63B 1/125; B63H 16/18; B63H 20/007
See application file for complete search history.

(56) References Cited

U.S. PATENT DOCUMENTS

| | | | | |
|---|---|---|---|---|
| 2,033,637 A | | 3/1936 | Kaiser | |
| 2,940,090 A | * | 6/1960 | Fournier | B63B 34/56 441/77 |
| 3,648,644 A | * | 3/1972 | Smith | B63H 1/34 440/96 |
| 4,129,912 A | | 12/1978 | Robinson | |
| 4,589,365 A | | 5/1986 | Masters | |
| 4,771,723 A | | 9/1988 | Friesen | |
| 4,811,674 A | | 3/1989 | Stewart | |
| 4,960,396 A | | 10/1990 | Stolzer | |
| 5,194,023 A | | 3/1993 | Stone | |
| 5,460,551 A | | 10/1995 | Beres | |

(Continued)

OTHER PUBLICATIONS

Website: http://www.outdoorgulfcoast.com/adaptive-kayaking/ Downloaded Feb. 22, 2018 Adaptive Kayaking Foot paddle—Mark Theobald uses a sit-on-top kayak with a stable stand for the paddle in which the person can paddle with his or her feet.

(Continued)

*Primary Examiner* — Stephen P Avila
(74) *Attorney, Agent, or Firm* — Russ Weinzimmer & Associates, P.C.

(57) ABSTRACT

A tri-hull fishing kayak includes a platform, an elevated seat, a foot operated paddle, and a triple hull including two side pontoons and one forward central pontoon having a front portion and a rear portion. The front portion, extending centrally from the platform, provides enhanced longitudinal stability. The two side pontoons are of a width and separation to provide enhanced lateral stability. The tri-hull fishing kayak reduces the need to frequently re-position the kayak when there is wind and/or current, thereby minimizing interruptions to fishing. The elevated seat is ergonomic for long-term sitting, and is high enough above the water to facilitate effective pitching and casting underhand, and to permit a steeper viewing angle into the water, thereby making sight fishing easier. The foot-operated paddle can be used to precisely steer the kayak, and therefore frees up the user's hands for fishing. Further, the platform enables fishing while standing.

17 Claims, 12 Drawing Sheets

(56) References Cited

U.S. PATENT DOCUMENTS

| | | | | |
|---|---|---|---|---|
| 5,590,616 | A * | 1/1997 | Vera | B63B 35/38 114/61.16 |
| 6,112,692 | A | 9/2000 | Lekhtman | |
| 6,595,813 | B1 | 7/2003 | Lekhtman | |
| 6,632,111 | B2 | 10/2003 | Oathout | |
| 6,755,145 | B2 * | 6/2004 | Bolebruch | B63B 34/20 114/347 |
| 7,320,291 | B2 * | 1/2008 | Eckert | B63B 25/002 114/347 |
| 7,354,326 | B2 * | 4/2008 | Lukens | B63B 34/56 441/76 |
| 7,461,612 | B1 | 12/2008 | Houck | |
| 8,668,536 | B1 | 3/2014 | Burnham | |
| 8,943,994 | B2 * | 2/2015 | Baldwin | B63B 1/14 114/284 |
| 8,992,272 | B1 | 3/2015 | Malakiman | |
| 9,079,649 | B2 * | 7/2015 | Heuton | B63B 34/20 |
| 10,479,467 | B2 * | 11/2019 | McCall | B63H 16/04 |
| 10,543,894 | B2 * | 1/2020 | Martin | B63B 1/121 |
| 10,556,656 | B2 * | 2/2020 | Kuntz | B63H 1/32 |
| 2002/0129756 | A1 * | 9/2002 | Myers | B63B 1/121 114/354 |
| 2006/0254495 | A1 | 11/2006 | Eckert | |
| 2007/0012236 | A1 | 1/2007 | Caples | |
| 2007/0015420 | A1 | 1/2007 | Vartanian | |
| 2007/0107646 | A1 | 5/2007 | Alvarez-Calderon | |
| 2012/0060737 | A1 * | 3/2012 | Wong | B63B 43/14 114/123 |
| 2013/0157529 | A1 * | 6/2013 | Santa Catarina | B63B 1/12 440/21 |

OTHER PUBLICATIONS

Website: https://www.hobie.com/pedalboards/mirage-eclipse/ Downloaded Feb. 25, 2018 Mirage Eclipse.

Website: http://www.ecochunk.com/1420/2012/07/30/amphibious-bike-becomes-a-raft-to-pedal-boat-on-waterways/ Downloaded Feb. 25, 2018 Amphibious Bike Becomes a Raft to Pedal Boat on Waterways the Bike Raft is especially designed for the bikers moving around the Han River, where they can lend a boat with a special holder that connects to the pedal of the bike on an axis to turn it into an amphibious vehicle.

Website: https://weburbanist.com/2009/05/21/15-creatively-offbeat-canoes-kayaks-boats/ Downloaded Feb. 25, 2018 WaveWalk Kayak WaveWalk kayaks are so stable they can be stood up in and fished from.

* cited by examiner

TRI-HULL FISHING KAYAK WITH ELEVATED SEAT AND FOOT-OPERATED PADDLES

FIELD OF INVENTION

This invention relates generally to kayaks, and more particularly to kayaks enhanced for fishing.

BACKGROUND OF THE INVENTION

The popularity of fishing from kayaks has increased dramatically in recent years. Fishing from a kayak is attractive for many reasons, including the small size and minimal draft of the kayak, which allows for launching and fishing in areas that are difficult to access using a traditional boat. Also, the small size and light weight of a kayak allows one person to move the kayak from home to a fishing spot with little preparation or help. Additionally, there is no need to charge and carry heavy batteries for a trolling motor, or to deal with the difficulties of launching a traditional boat.

Current kayak manufactures have seized on the expansion of the use of kayaks for fishing by enhancing traditional kayak designs. Such enhancements include: improved seat construction, added amenities specific to the needs of fishing, and foot pedal propulsion to create a somewhat hands-free experience.

Yet, there are challenges in fishing from presently available kayaks, including the need to frequently re-position the kayak when there is wind and/or current, which repeatedly interrupts fishing. Also, the seat in presently available kayaks is not ergonomic for long-term sitting, because one's feet are nearly at waist level at all times, which puts a strain on one's lower back. Further, in presently available kayaks the seat is too close to the water to effectively pitch or cast underhand to get under overhanging cover. Also, the seat in presently available kayaks is too close to the water, thereby causing a shallow viewing angle into the water that makes sight fishing difficult.

Pedal Kayaks are available on the market. Users of a pedal kayak use their legs to propel the kayak using a rotating propeller, or a set of underwater "flippers", instead of using their arms to propel and steer the kayak using a traditional kayak paddle. Although pedal kayaks reduce the need to pick up a paddle to propel the kayak, one must still use a hand-operated rudder to steer the kayak, which does not allow precise adjustment of position, and takes one's hands away from fishing. Further, the seat in a pedal kayak is too low, which means it is not ergonomic. And the seat is too close to the water to effectively pitch or cast underhand, which also causes a shallow viewing angle into the water that makes sight fishing difficult. Moreover, pedal kayaks are complex and expensive. Thus, pedal kayaks fail to provide an ideal platform from which to fish.

SUMMARY OF THE INVENTION

A tri-hull fishing kayak with elevated seat and foot-operated paddles is provided having three hulls that reduce the need to frequently re-position the fishing kayak when there is wind and/or current, thereby minimizing interruptions to fishing. The elevated seat is more ergonomic for long-term sitting, thereby avoiding placing a strain on one's lower back. The elevated seat is high enough above the water so as to facilitate effective pitching and casting underhand to get under overhanging cover. Also, the elevated seat of the tri-hull fishing kayak is sufficiently above the water so as to permit a steeper viewing angle into the water, thereby making sight fishing easier.

The fishing kayak of the invention does not use a rotating propeller, or a set of underwater "flippers", instead using a pivoting foot-operated paddle powered by the legs and feet of the user to propel and steer the kayak. The user's feet are placed on a pair of foot rests on the foot-operated paddle, each foot rest including a three-axis articulation joint, each three-axis articulation joint being configured to ergonomically support a foot throughout an entire cycle of operation of the foot-operated paddle.

Thus, the pivoting foot-operated paddle can be used to steer the kayak with precise adjustment of position, and therefore frees up the user's hands for fishing. Further, a platform is provided that enables fishing while standing. Moreover, the fishing kayak of the invention is mechanically simple, and inexpensive to manufacture. Accordingly, the fishing kayak of the invention provides an ideal water craft from which to fish.

A general aspect of the invention is a tri-hull fishing kayak including: a platform, the platform having a right side, a left side, a front side, and a rear side; a seat, the seat including a seat back and a seat base, the seat being attachable to the platform; a right side pontoon configured to support the right side of the platform, the right side pontoon being in integrally molded relationship with the platform; a left side pontoon configured to support the left side of the platform, the left side pontoon being in integrally molded relationship with the platform; and a forward central pontoon having a front portion and a rear portion, the rear portion configured to support the front side of the platform, the front portion extending forward from the front side of the platform, and the front portion having a plurality of locations configured to support a pivot assembly, the rear portion being in integrally molded relationship with the platform; a foot-operated paddle having a pair of paddles and a pair of foot rests; and a pivot assembly, the pivot assembly configured to pivotably support the foot-operated paddle, the pivot assembly being attachable at one of the plurality of locations of the front portion.

In some embodiments, each foot rest of the pair of foot rests includes a three-axis articulation joint attached to the foot rest, the three-axis articulation joint being configured to ergonomically support a foot throughout an entire cycle of operation of the foot-operated paddle.

In some embodiments, the seat includes a plurality of seat height adjustment holes. In some embodiments, the seat base is pivotable upward against the seat back so as to enable a user to stand on the platform.

In some embodiments, the platform is of a width between 36" to 49".

In some embodiments, the tri-hull fishing kayak further includes: a right roller mounted under a trailing edge of the right side pontoon; a left roller mounted under a trailing edge of the left side pontoon; a handle mounted on a leading edge of the forward central pontoon, the handle being configured to lift the forward central pontoon, while the trailing edge of the right side pontoon and the trailing edge of the left side pontoon roll along on the right roller and the left roller respectively, for easy transportation over land.

In some embodiments, the platform includes: at least one fishing rod holder reachable by a user sitting on the seat.

In some embodiments, the platform includes: a storage compartment inside the platform.

In some embodiments, the platform includes: a mounting rail along an edge of the platform.

In some embodiments, the tri-hull fishing kayak further includes: a transom on a back top edge of the platform, the transom configured to mount an electric trolling motor.

In some embodiments, the platform includes: a battery storage compartment under the seat.

Another general aspect of the invention is a tri-hull fishing kayak that includes: a platform, the platform having a right side, a left side, a front side, and a rear side; a seat, the seat being in integrally molded relationship with the platform; a right side pontoon configured to support the right side of the platform, the right side pontoon being attachable to the platform; a left side pontoon configured to support the left side of the platform, the left side pontoon being attachable to the platform; a forward central pontoon having a front portion and a rear portion, the rear portion configured to support the front side of the platform, the front portion extending forward from the front side of the platform, and the front portion having a plurality of locations configured to support a pivot assembly, the rear portion being attachable to the platform; a foot-operated paddle having a pair of paddles and a pair of foot rests; and a pivot assembly, the pivot assembly configured to pivotably support the foot-operated paddle, the pivot assembly being attachable at one of the plurality of locations of the front portion.

Yet another general aspect of the invention is a tri-hull fishing kayak including: a platform, the platform having a right side, a left side, a front side, and a rear side; a seat, the seat being in integrally molded relationship with the platform; a right side pontoon configured to support the right side of the platform, the right side pontoon being in integrally molded relationship with the platform; a left side pontoon configured to support the left side of the platform, the left side pontoon being in integrally molded relationship with the platform; and a forward central pontoon having a front portion and a rear portion, the rear portion configured to support the front side of the platform, the front portion extending forward from the front side of the platform, and the front portion having a plurality of locations configured to support a pivot assembly, the rear portion being in integrally molded relationship with the platform; a foot-operated paddle having a pair of paddles and a pair of foot rests; and a pivot assembly, the pivot assembly configured to pivotably support the foot-operated paddle, the pivot assembly being attachable at one of the plurality of locations of the front portion.

In some embodiments, each foot rest of the pair of foot rests includes a three-axis articulation joint attached to the foot rest, the three-axis articulation joint being configured to ergonomically support a foot throughout an entire cycle of operation of the foot-operated paddle.

In some embodiments, the tri-hull fishing kayak further includes: a right roller mounted under a trailing edge of the right side pontoon; a left roller mounted under a trailing edge of the left side pontoon; and a handle mounted on a leading edge of the forward central pontoon, the handle being configured to lift the forward central pontoon, while the trailing edge of the right side pontoon and the trailing edge of the left side pontoon roll along on the right roller and the left roller respectively, for easy transportation over land.

Still another general aspect of the invention is a tri-hull fishing kayak including: a platform, the platform having a right side, a left side, a front side, and a rear side; a seat, the seat including a seat back and a seat base, the seat being attachable to the platform; a right side pontoon configured to support the right side of the platform, the right side pontoon being attachable to the platform; a left side pontoon configured to support the left side of the platform, the left side pontoon being attachable to the platform; a forward central pontoon having a front portion and a rear portion, the rear portion configured to support the front side of the platform, the front portion extending forward from the front side of the platform, and the front portion having a plurality of locations configured to support a pivot assembly, the rear portion being attachable to the platform; a foot-operated paddle having a pair of paddles and a pair of foot rests; and a pivot assembly, the pivot assembly configured to pivotably support the foot-operated paddle, the pivot assembly being attachable at one of the plurality of locations of the front portion.

Still yet another general aspect of the invention is a tri-hull fishing kayak including: a platform, the platform having a right half platform and a left half platform, the right half platform being attachable to the left half platform so as to provide an assembled platform, the assembled platform having a right side, a left side, a front side, and a rear side; a seat, the seat including a seat back and a seat base, the seat being attachable to the assembled platform; a right side pontoon configured to support the right side of the assembled platform, the right side pontoon being in integrally molded relationship with the right half platform; a left side pontoon configured to support the left side of the platform, the left side pontoon being in integrally molded relationship with the left half platform; a forward central pontoon having a front portion and a rear portion, the rear portion configured to support the front side of the assembled platform, the front portion extending forward from the front side of the assembled platform, and the front portion having a plurality of locations configured to support a pivot assembly, the rear portion being attachable to both the right half platform and the left half platform; a foot-operated paddle having a pair of paddles and a pair of foot rests; and a pivot assembly, the pivot assembly configured to pivotably support the foot-operated paddle, the pivot assembly being attachable at one of the plurality of locations of the front portion.

In some embodiments, each foot rest of the pair of foot rests includes a three-axis articulation joint attached to the foot rest, the three-axis articulation joint being configured to ergonomically support a foot throughout an entire cycle of operation of the foot-operated paddle.

In some embodiments, the tri-hull fishing kayak further includes: a right roller mounted under a trailing edge of the right side pontoon; a left roller mounted under a trailing edge of the left side pontoon; and a handle mounted on a leading edge of the forward central pontoon, the handle being configured to lift the forward central pontoon, while the trailing edge of the right side pontoon and the trailing edge of the left side pontoon roll along on the right roller and the left roller respectively, for easy transportation over land.

BRIEF DESCRIPTION OF THE DRAWINGS

Many additional features and advantages will become apparent to those skilled in the art upon reading the following description, when considered in conjunction with the accompanying drawings, wherein.

DETAILED DESCRIPTION

Figure 1A:
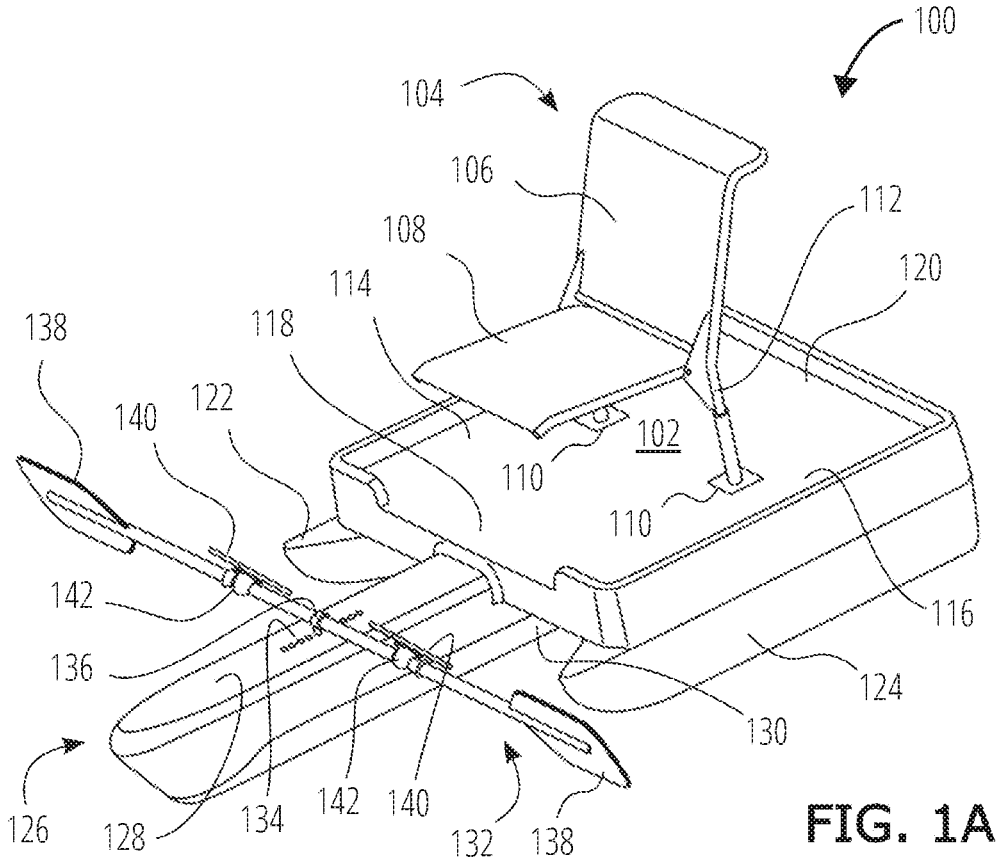
FIG. 1A is an isometric view of a tri-hull fishing kayak with a platform having three pontoons integral with the platform, an elevated tube frame seat, and two foot-operated paddles.

With reference to FIG. 1A, an isometric view of an embodiment of a tri-hull fishing kayak 100 is shown having a seat 104 that includes a seat back 106, a seat base 108, and seat supports 112. The seat supports 112 rest upon two platform seat attachments 110 configured to attach the seat 104 to a platform 102. The platform 102 includes a right side 114, a left side 116, a front side 118, and a rear side 120. The platform 102 is supported above a water surface 1110 (shown in FIG. 11) by a right side pontoon 122, a left side pontoon 124, and a forward central pontoon 126. The right side pontoon 122 is configured to support the right side 114, and the left side pontoon 124 is configured to support the left side 116. The forward central pontoon 126 includes a front portion 128 and a rear portion 130. The rear portion 130 of the forward central pontoon 126 is configured to support the front side 118 of the platform 102.

In this embodiment, the left side pontoon 124 and the right side pontoon 122 are in integrally molded relationship with the platform 102.

In this embodiment, the rear portion 130 of the forward central pontoon 126 is in integrally molded relationship with the platform 102.

In other embodiments, the left side pontoon 124 and the right side pontoon 122 are attached to the platform 102, and the rear portion 130 of the forward central pontoon 126 is also attached to the platform 102.

Also shown is a foot-operated paddle 132 for use by a user 602 (shown in FIG. 6) to paddle the tri-hull fishing kayak 100 through the water. The foot-operated paddle 132 includes a pair of paddles 138, a foot rest 140 for each foot 616 of the user 602 (shown in FIG. 6), and a three-axis (forward/backward, side-to-side, and clockwise/counter-clockwise rotation) articulation joint 142 attached to each foot rest 140. The three-axis articulation joint 142 is configured to ergonomically support a foot 616 throughout an entire cycle of operation of the foot-operated paddle 132, as shown, for example, in FIG. 11.

The foot-operated paddle 132 includes a pivot assembly 136, the pivot assembly 136 being configured to pivotally support the foot-operated paddle 132 above the forward central pontoon 126. The pivot assembly 136 can perform both pivot and see-saw (See FIG. 11) actions. The pivot assembly 136 is removably inserted at one of a plurality of holes 134 on the forward central pontoon 126 (See FIG. 10A).

Figure 1B:
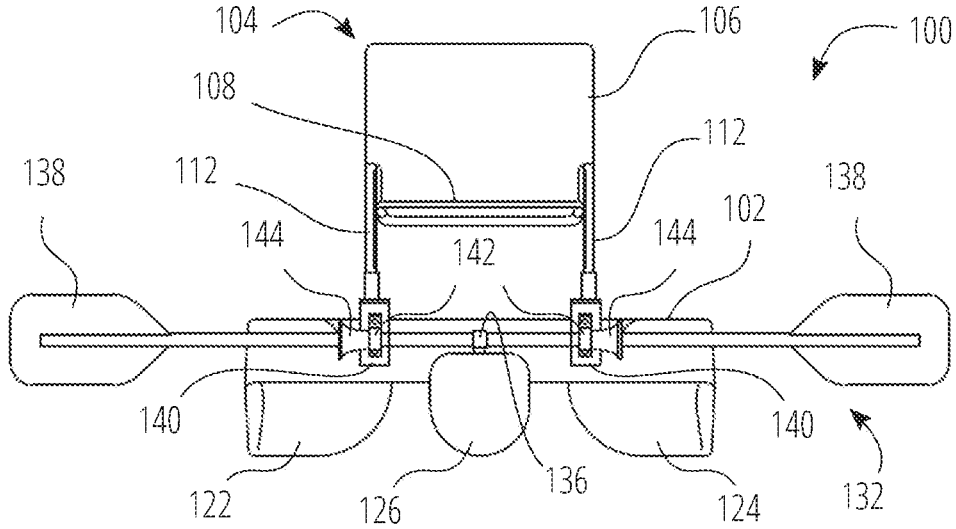
FIG. 1B is a front view of the tri-hull fishing kayak of FIG. 1A.

With reference to FIG. 1B, a front view of the embodiment of the tri-hull fishing kayak 100 of FIG. 1A is shown. The tri-hull fishing kayak 100 includes the seat 104 having the seat back 106, the seat base 108, and the seat supports 112. The seat is supported by the platform 102. The platform 102 is supported above the water surface 1110 (shown in FIG. 11) by the right side pontoon 122, the left side pontoon 124, and the forward central pontoon 126.

Also shown is a foot-operated paddle 132 used by the user 602 (shown in FIG. 6) to paddle the tri-hull fishing kayak 100 through the water. The foot-operated paddle 132 includes the pair of paddles 138, the foot rest 140 for each foot 616 of the user 602 (shown in FIG. 6), and the three-axis articulation joint 142 attached to each foot rest 140. The three-axis articulation joint 142 is configured to ergonomically support a foot 616 throughout an entire cycle of operation of the foot-operated paddle 132.

The foot-operated paddle 132 includes a pivot assembly 136, the pivot assembly 136 being configured to pivotally support the foot-operated paddle 132 above the forward central pontoon 126.

The foot-operated paddle 132 also includes a pair of drip rings 144 configured to catch water running along the foot-operated paddle 132.

Figure 2:
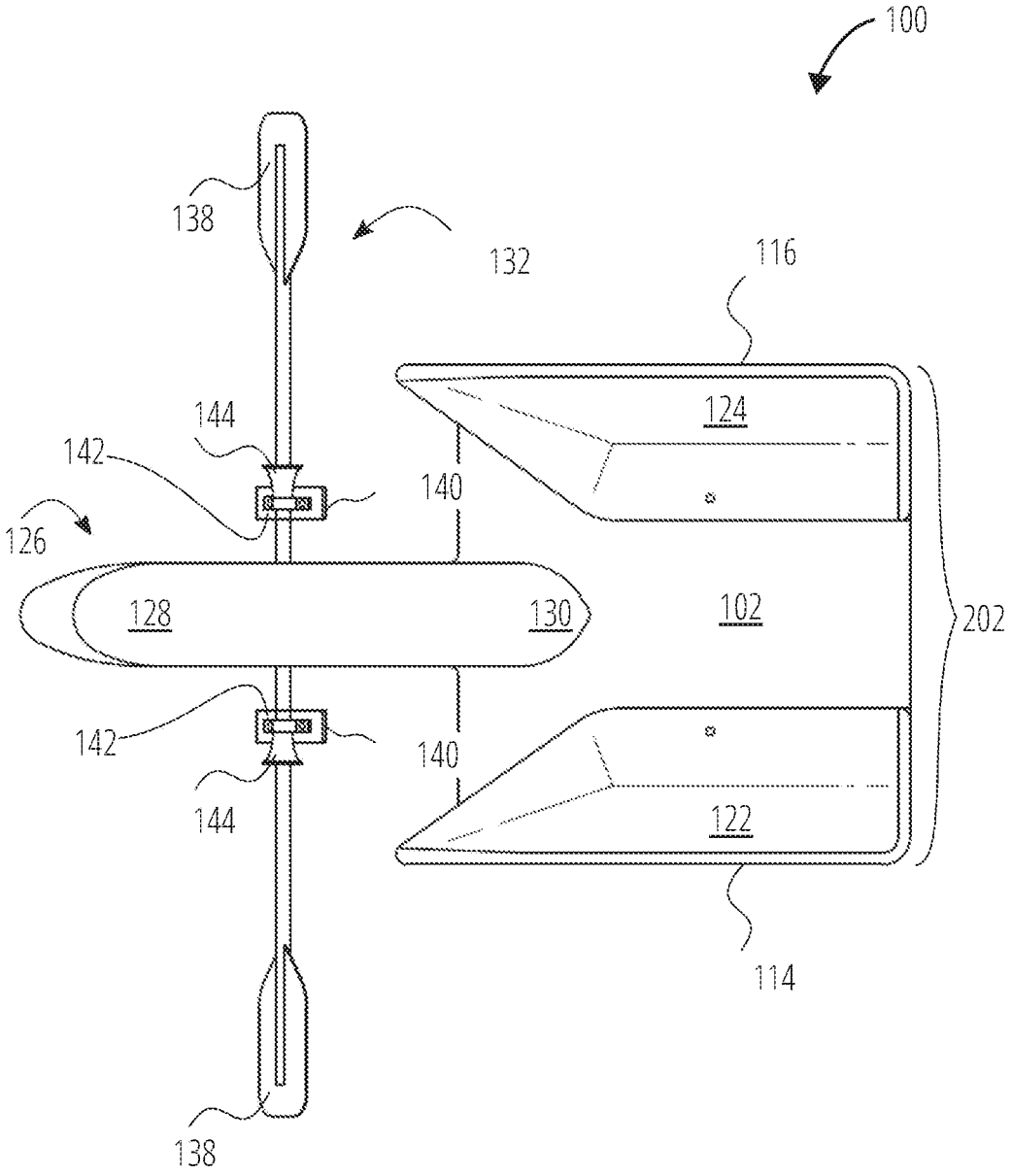
FIG. 2 is a bottom view of the tri-hull fishing kayak of FIG. 1A showing the configuration of pontoons that provide stability and minimize drag when paddling the tri-hull fishing kayak.

With reference to FIG. 2, a bottom view of the embodiment of the tri-hull fishing kayak 100 of FIG. 1A is shown, showing the configuration of pontoons that provide stability and minimize drag when paddling the tri-hull fishing kayak 100. The tri-hull fishing kayak 100 includes the right side pontoon 122 at the right side 114, the left side pontoon 124 at the left side 116, and the forward central pontoon 126. The forward central pontoon 126 includes the front portion 128 and the rear portion 130. The platform 102 is supported by above the water surface 1110 (shown in FIG. 11) by the right side pontoon 122, the left side pontoon 124, and the forward central pontoon 126.

The left side pontoon 124 and the right side pontoon 122 are of a separation so as to provide enhanced lateral stability. In addition, the right side pontoon 122 and left side pontoon 124 are spaced apart to be located at the right side 114 and left side 116 boundaries of the platform 102 to provide enhanced lateral stability when the tri-hull fishing kayak 100 is in the water. Therefore, the right side pontoon 122 is located under the right side 114 of the platform 102, and the left side pontoon 124 is located under the left side 116.

The platform 102 has a platform width 202. The left side pontoon 124 and the right side pontoon 122 are positioned such that they span the platform width 202 to provide enhanced lateral stability. In some embodiments, the platform width 202 is a width between 36" to 49".

Also shown is the foot-operated paddle 132, including the pair of paddles 138, each of the two foot rests 140, each of the two three-axis articulation joints 142, and the two drip rings 144 configured to catch water running along the foot-operated paddle 132.

Figure 3:
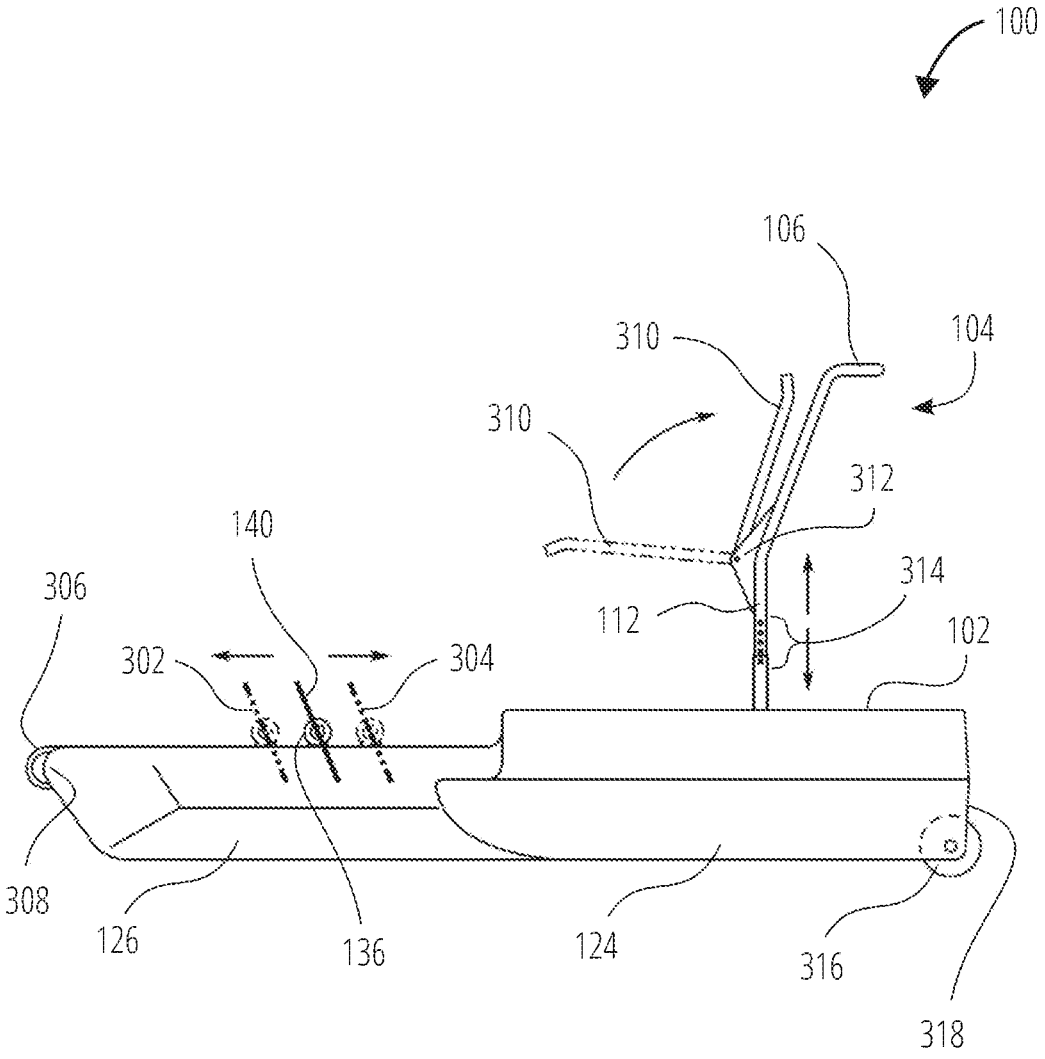
FIG. 3 is a side view of the tri-hull fishing kayak of FIG. 1A, showing how the seat base can optionally pivot upward toward the seat back, showing a plurality of seat height adjustment holes, showing a plurality of locations of the foot paddle pivot along the forward central pontoon, and showing wheels on the back of the tri-hull fishing kayak combined with a handle on the front to facilitate easy transportation of the tri-hull fishing kayak.

With reference to FIG. 3, a side view of the embodiment 100 of the tri-hull fishing kayak of FIG. 1A is presented, showing how the seat base 310 can optionally pivot on a seat base pivot 312, upward toward the seat back 106, so as to enable a user 602 (shown in FIG. 6) to stand on the platform 102. This embodiment also includes a plurality of seat height adjustment holes 314 configured to set the height of the seat 104. In addition, included along the top of the forward central pontoon 126 are the plurality of holes 134 (shown in FIG. 1A) providing possible locations for inserting the pivot assembly 136. As an example of possible foot rest 140 locations, shown are a pair of foot rests in forward position 302, corresponding to the foot 616 position of a user 602 (both shown in FIG. 6) with longer legs compared to another user with shorter legs that would place the pair of foot rests 140 in rearward position 304. The plurality of locations 134 of the foot rests 140 enables users with different length legs to easily reposition the location of the foot rests 140.

Figure 6:
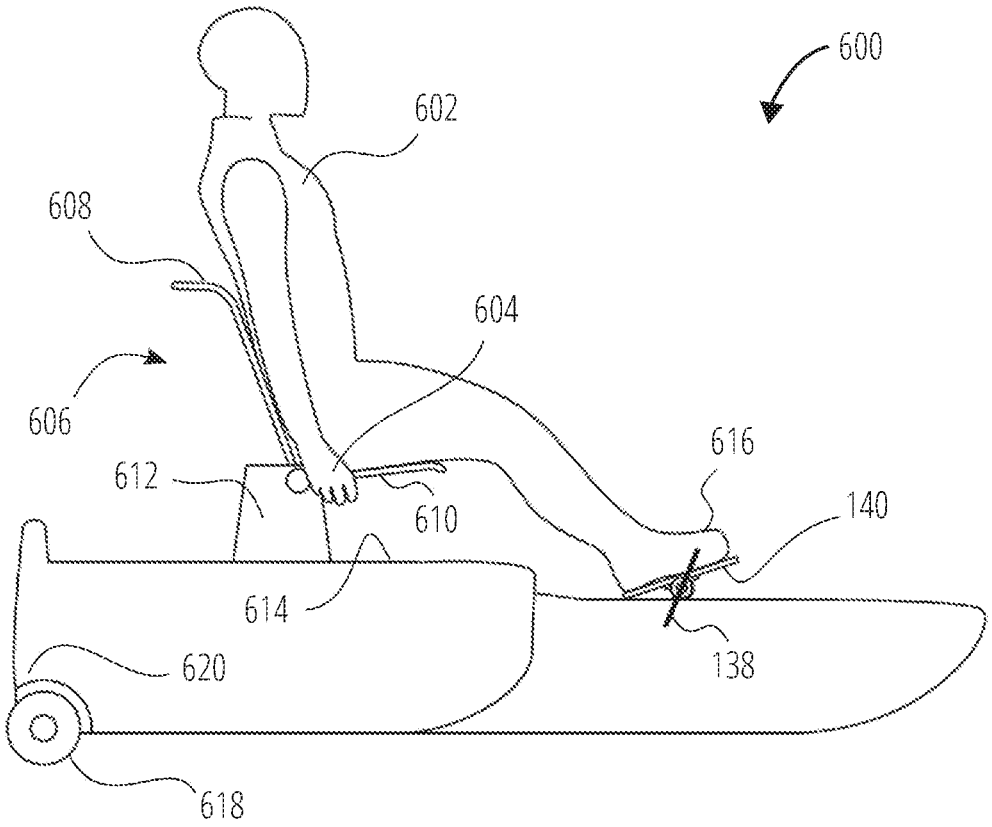
FIG. 6 is a side view of another embodiment of a tri-hull fishing kayak having three pontoons integrally molded with the platform, and an elevated seat attached to the platform, showing a user sitting on a seat having a wide seat support, and having the user's feet placed on the foot rests of the paddles, leaving the user's hands free.

Some embodiments can include a pair of rollers, including a left roller 316 under a trailing edge of the left side pontoon 318, and a right roller (obscured behind the left roller 316 in this view) under the trailing edge of the right side pontoon 620 (shown in FIG. 6). The pair of rollers can be used with a handle 306 on the leading edge 308 of the forward central pontoon 126 to accomplish easy transportation of the tri-hull fishing kayak 300 over land.

Figure 4A:
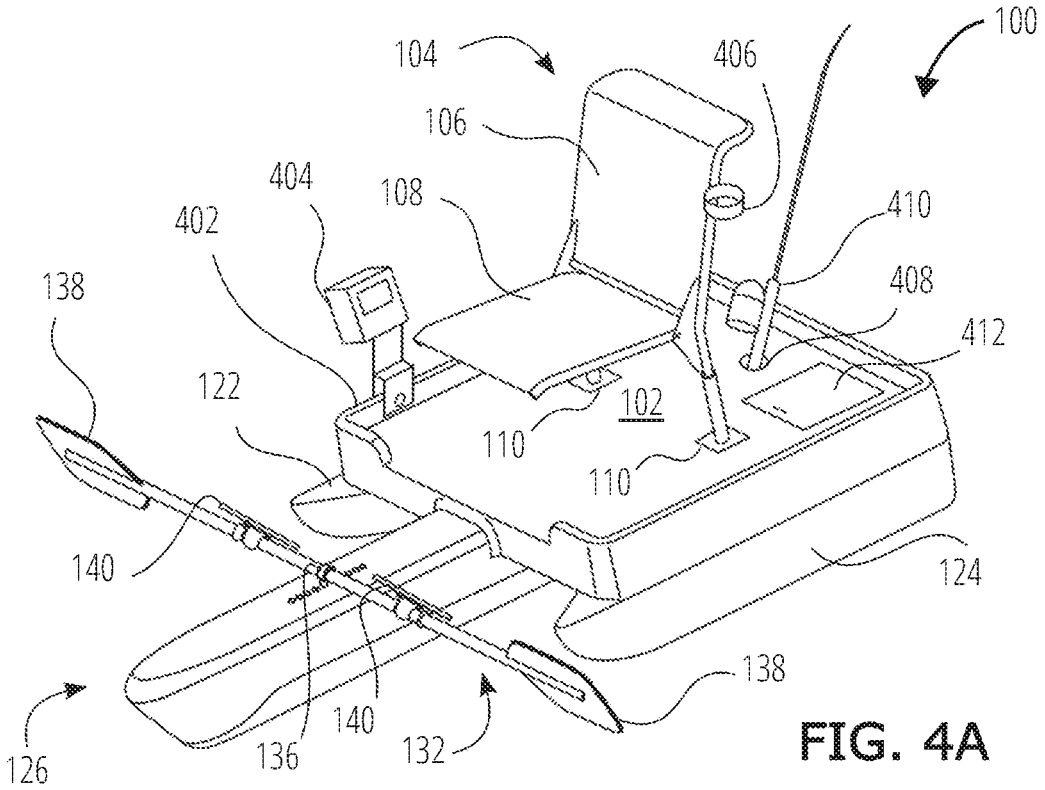
FIG. 4A is an isometric view of the tri-hull fishing kayak of FIG. 1A, showing possible accessories, including a cup holder, a fishing rod holder, a storage compartment, and a fish finder.

With reference to FIG. 4A, an isometric view of the embodiment of a tri-hull fishing kayak 100 is shown, showing possible accessories, including a seat-side cup holder 406, a fishing rod holder 408 configured to hold a fishing rod 410, a storage compartment 412, and a fish finder 404. The fish finder 404 is mounted on a mounting rail 402 at the periphery of the platform 102. The fishing rod holder 408 is reachable by the user 602 (shown in FIG. 6) sitting in the seat 104. The storage compartment 412 is located inside the platform 102.

Figure 4B:
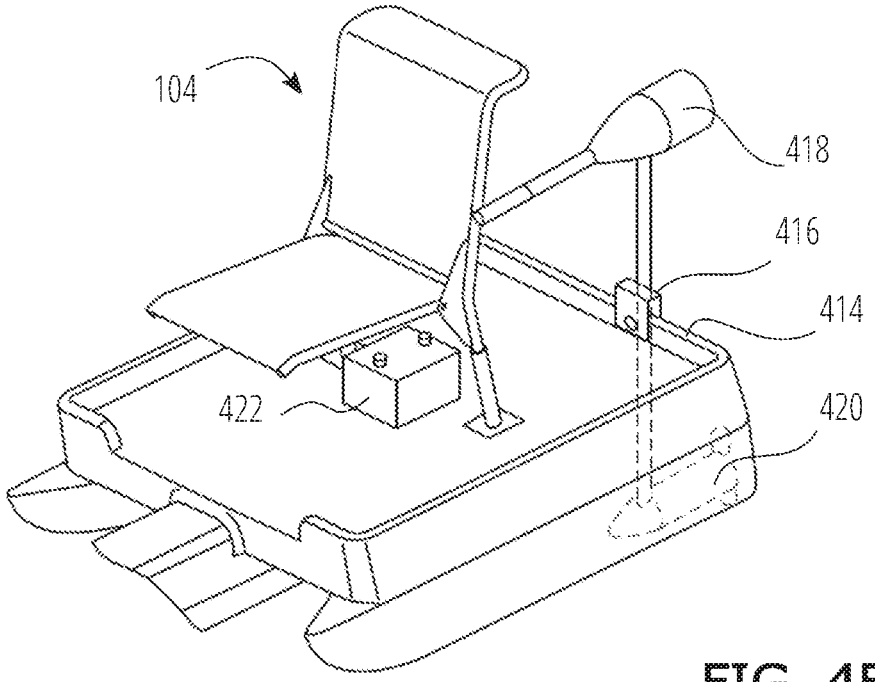
FIG. 4B is an isometric view of the tri-hull fishing kayak of FIG. 1A, showing an added transom, an electric trolling motor mounted on the transom, and a battery under the seat.

With reference to FIG. 4B, an isometric view of the tri-hull fishing kayak 100 of FIG. 1A is shown, showing possible accessories, including an added transom mounting rail 414, and a transom mounting bracket 416 configured to mount an electric trolling motor control 418, and an electric trolling motor 420. Also shown is a battery 422 under the seat 104.

Figure 5:
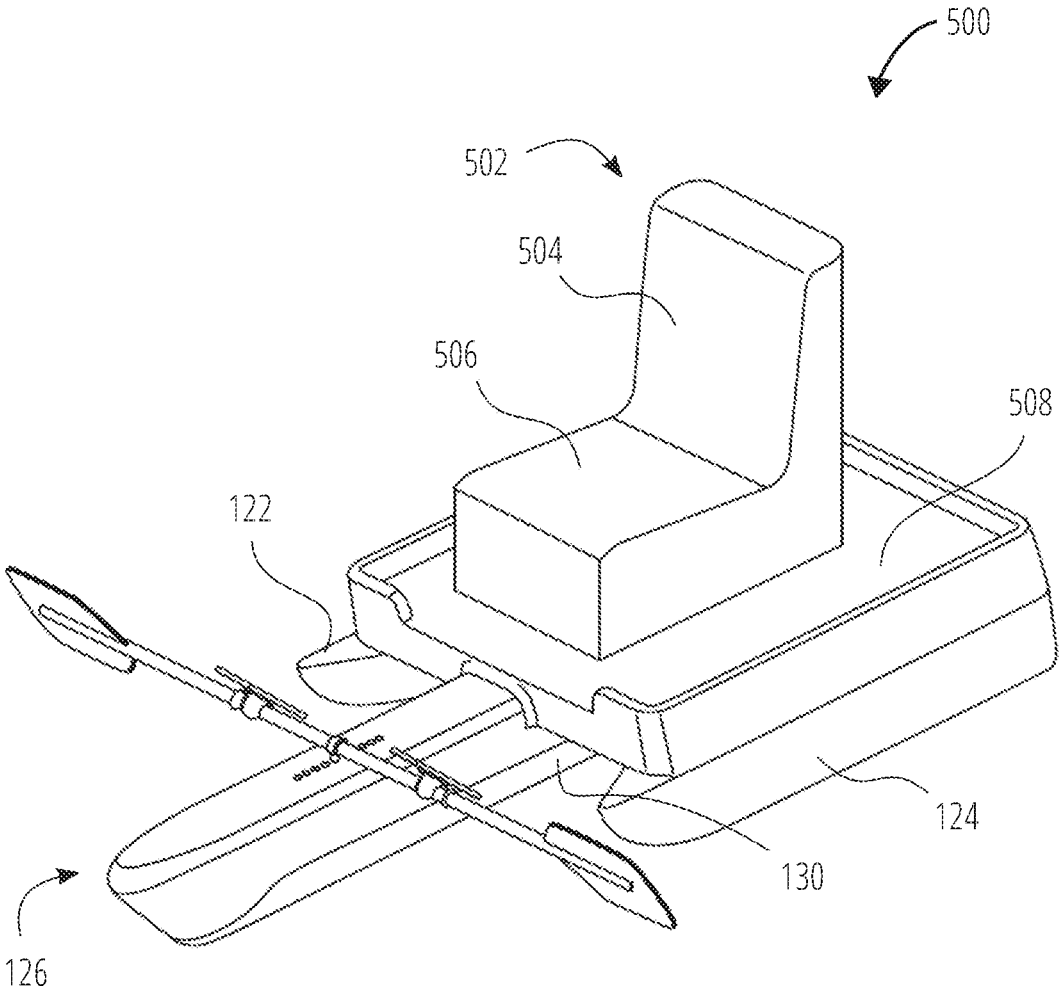
FIG. 5 is an isometric view of another embodiment of a tri-hull fishing kayak, showing a molded seat that is integrally molded with the platform, and three separable pontoons attached to the platform.

With reference to FIG. 5, an isometric view of another embodiment 500 of a tri-hull fishing kayak, showing an integrally molded seat 502, including a formed seat back 504 and a formed seat base 506 that are both integrally molded with the platform 508 of the tri-hull fishing kayak 500. In some embodiments, the right side pontoon 122, the left side pontoon 124, and the rear portion 130 of the forward central pontoon 126 are in integrally molded relationship with the platform 508. In other embodiments, the right side pontoon 122, the left side pontoon 124, and the rear portion 130 of the forward central pontoon 126 are attachable to the platform 508.

With reference to FIG. 6, a side view of another embodiment 600 of a tri-hull fishing kayak is presented, showing a user 602 sitting on a seat back 608 and a seat base 610 of a seat 606, with each foot 616 placed on the foot rest 140 so as to control the pair of paddles 138, and leaving the hands of the user 604 free. The seat 606 is supported by a wide seat support 612 attached to a platform 614.

This embodiment 600 also includes a pair of rollers, including a right roller 618 under a trailing edge of the right side pontoon 620 and a left roller 316 (obscured behind the right roller 618) under the trailing edge of the left side pontoon 318 (shown in FIG. 3). The pair of rollers facilitate easy transportation of the tri-hull fishing kayak 600 over land.

Figure 7:
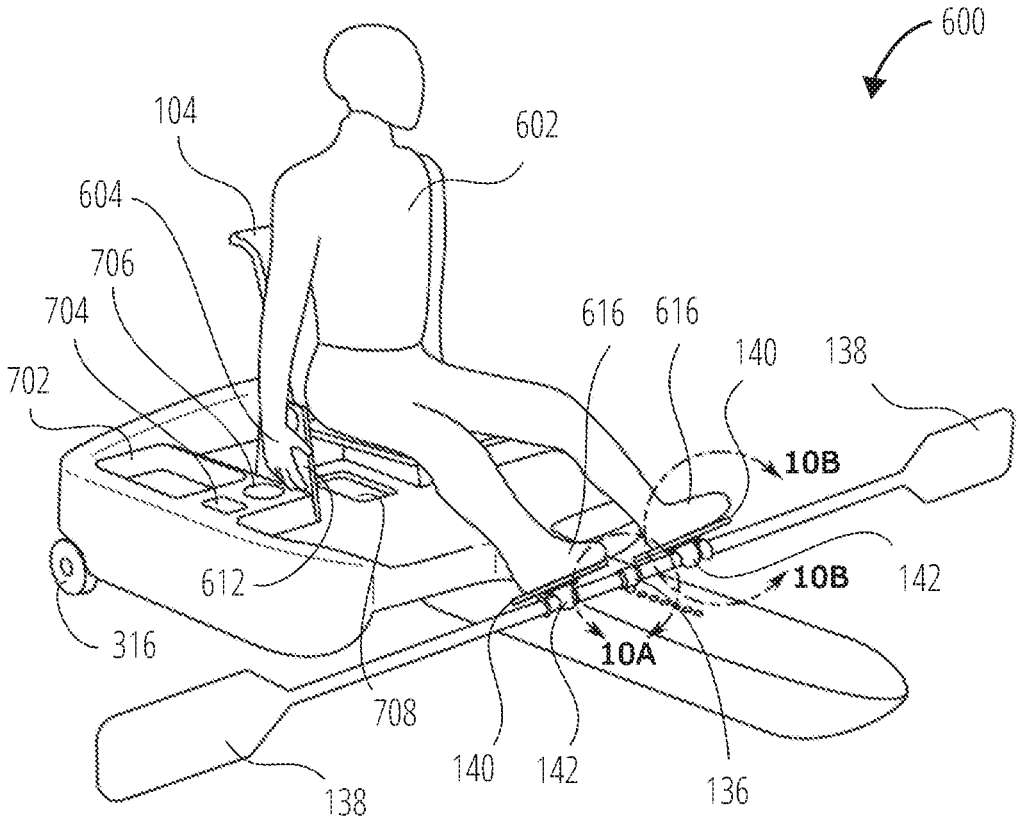
FIG. 7 is an isometric view of the tri-hull fishing kayak of FIG. 6, showing the user sitting on the seat with feet placed on the foot rests of the paddles, and showing a variety of optional features of the platform.
Figure 10A:
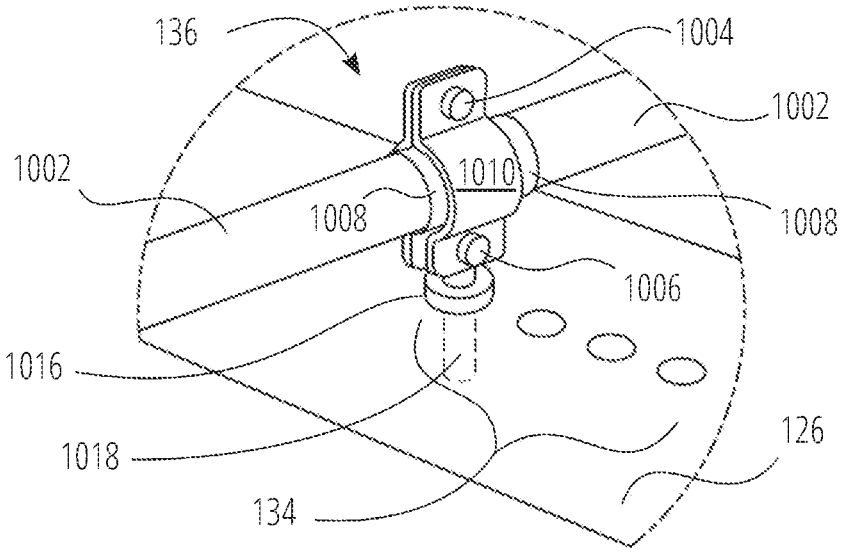
FIG. 10A is an isometric close-up view of the pivot assembly that allows the foot-operated paddle to both pivot and see-saw (but not twist), showing the foot-operated paddle in a horizontal position above the pivot assembly holding pin, the holding pin resting in one of the plurality of holes along the top of the forward central pontoon.

With reference to FIG. 7, an isometric view of another embodiment 600 of the tri-hull fishing kayak is presented, showing the user 602 sitting on the seat 104 having a wide seat support 612, each foot 616 being placed on each foot rest 140, and showing each three-axis articulation joint 142 (shown in detail in FIG. 10B) and the pivot assembly 136 (shown in detail in FIG. 10A).

Also shown are possible accessories, including a storage compartment 702, a small storage compartment 704, and a cup holder 706, these accessories being within easy reach of the hands of the user 604. Below the seat 104 is shown a battery storage compartment 708 configured to store a battery 422 (shown in FIG. 4B).

Figure 8:
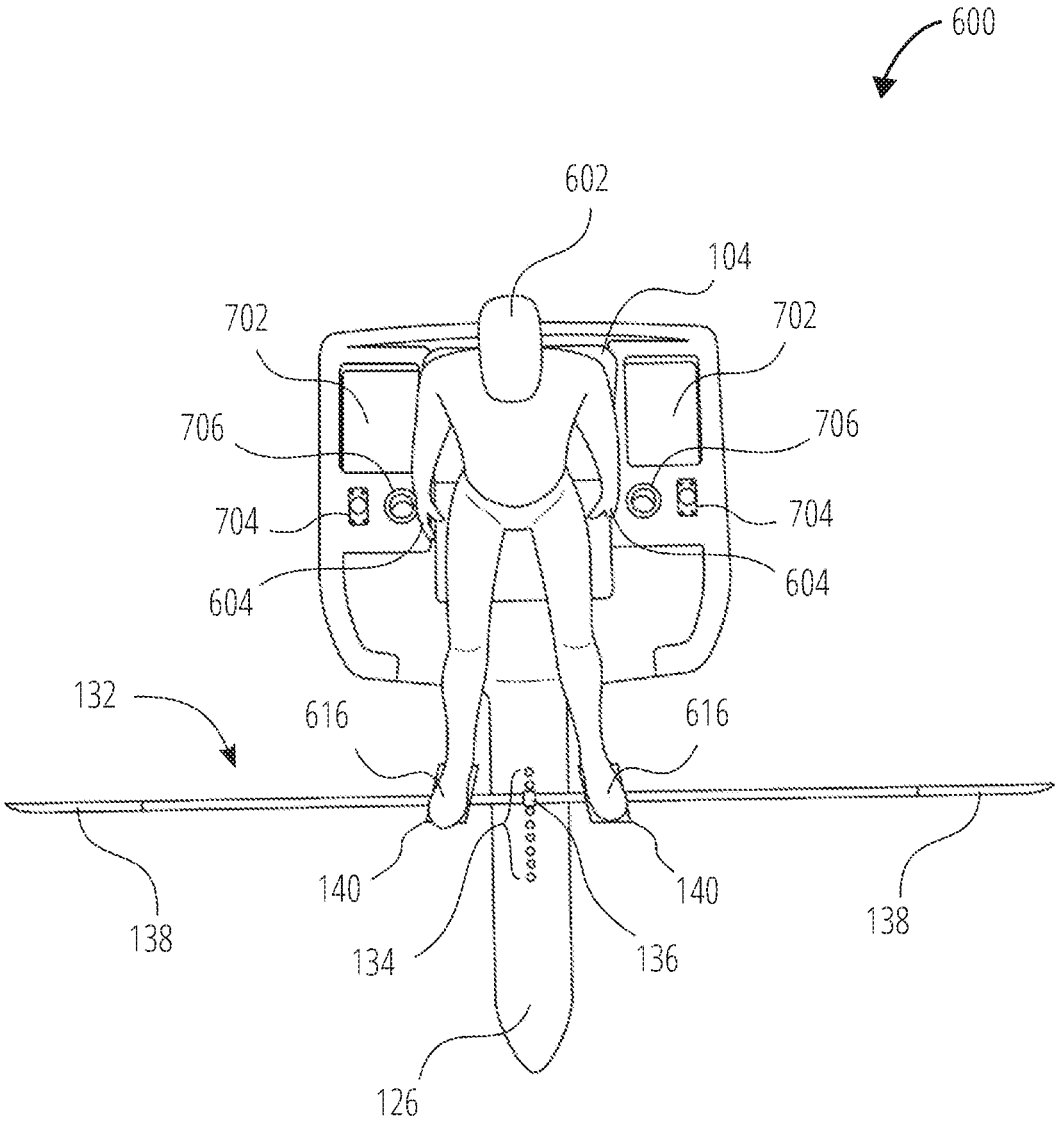
FIG. 8 is an overhead view of the embodiment of the tri-hull fishing kayak of FIG. 6 showing the user sitting on the seat with the user's feet placed on the foot rests of the paddles, also showing other possible accessories including storage compartments, small storage compartments, and cup holders.

With reference to FIG. 8, an overhead view of the embodiment 600 of the tri-hull fishing kayak of FIG. 6 is presented, showing the user 602 sitting on the seat 104 with each foot 616 placed on a respective foot rest 140. The foot-operated paddle 132 and the pair of attached paddles 138 are in a position substantially perpendicular to the forward central pontoon 126. Also shown are possible accessories including the storage compartment 702, the small storage compartment 704, and the cup holder 706, each accessory being within easy reach of the hands of the user 604.

Figure 9:
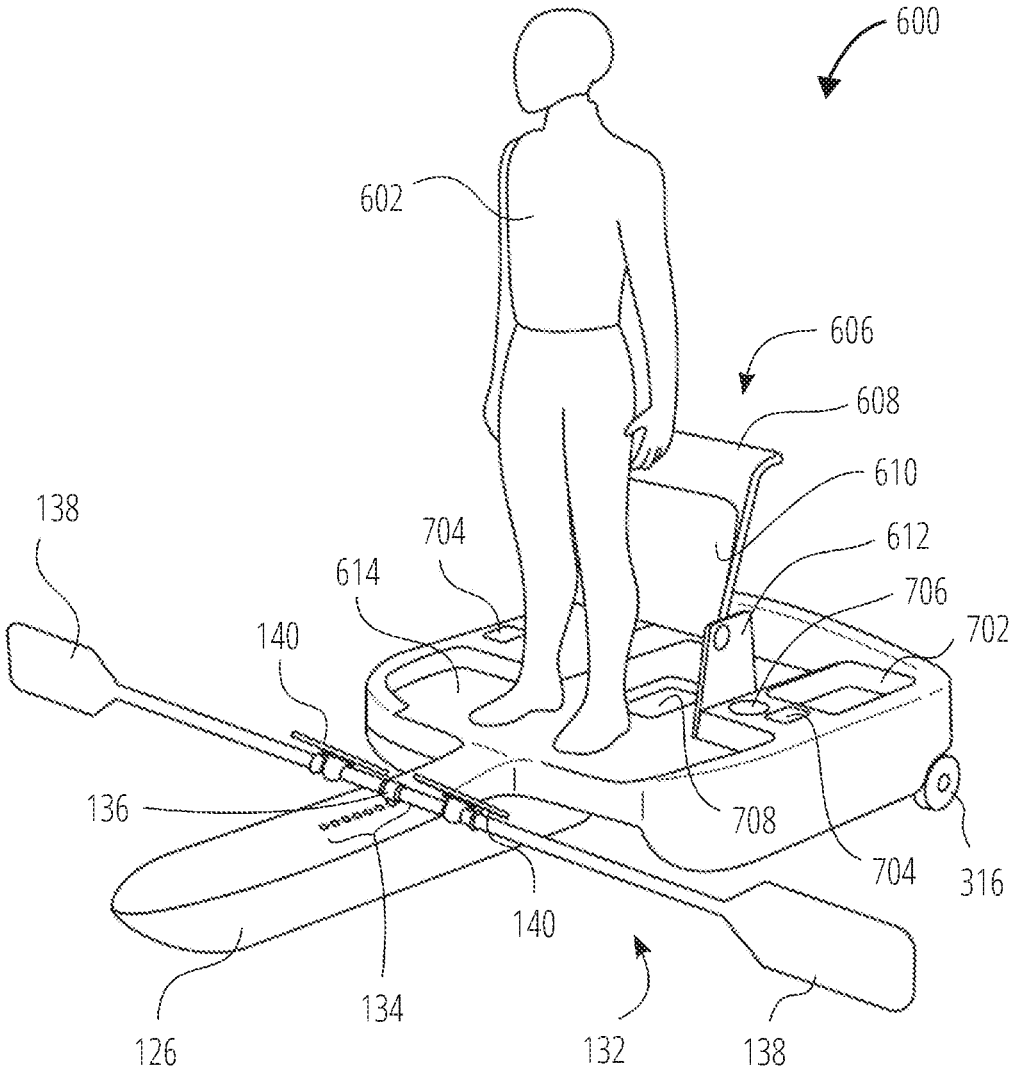
FIG. 9 is an isometric view of the embodiment of the tri-hull fishing kayak of FIG. 6 showing the user in an upright standing position, with the seat base pivoted to an upright position toward the seat back, demonstrating the stability of the tri-hull configuration when the user is in the upright standing position.

With reference to FIG. 9, an isometric view of the embodiment 600 of the tri-hull fishing kayak of FIG. 6 is shown, showing that a user 602 can stand in an upright position, with the seat base 610 pivoted to an upright position toward the seat back 608, showing the stability of the tri-hull configuration when the user 602 stands in an upright position.

With reference to FIG. 10A, an isometric close-up view is shown of the pivot assembly 136 that is mounted on the forward central pontoon 126. The pivot assembly 136 is mounted onto the forward central pontoon 126 by inserting a pivot assembly holding pin 1018 into one of the plurality of holes 134 located on the top of the forward central pontoon 126. The pivot assembly 136 includes an upper clamping bolt 1004 and a lower pivot bolt 1006. The upper clamping bolt 1004 clamps the pair of clamps 1010 together to firmly grip a paddle shaft 1002. A protective sleeve 1008 between the pair of clamps 1010 and the paddle shaft 1002 protects the paddle shaft 1002 and prevents the paddle shaft 1002 and the pair of clamps 1010 from rotating with respect to each other. The lower pivot bolt 1006 also clamps together the lower portion of the pair of clamps 1010.

The lower pivot bolt 1006 is rotatably mounted to the pivot assembly holding pin 1018. A pivot assembly holding collar 1016 of the pivot assembly holding pin 1018 is pivotally supported by the top surface of the forward central pontoon 126. As a result, the paddle shaft 1002 can pivot around the central axis of the pivot assembly holding pin 1018, and the paddle shaft 1002 can also pivot (seesaw) about the central axis of the lower pivot bolt 1006 mounted on top of the pivot assembly holding pin 1018, as each paddle of the pair of paddles 138 (shown in FIG. 1A) alternately dips into and out of the water (see FIG. 11).

Figure 10B:
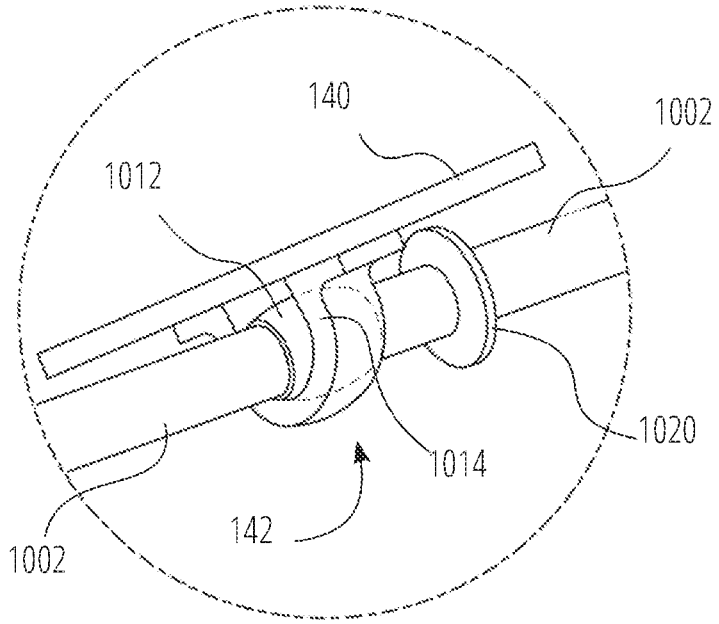
FIG. 10B is an isometric close-up view of the two-axis articulation joint showing the foot rest, the articulation joint capsule, the articulation joint knuckle, and the paddle shaft.

With reference to FIG. 10B, an isometric close-up view is shown of the three-axis articulation joint 142. The three-axis articulation joint 142 includes an articulation joint capsule 1014 that is fixedly attached to the foot rest 140. The articulation joint capsule 1014 surrounds an articulation joint knuckle 1012 that is fixedly attached to the paddle shaft 1002. The articulation joint capsule 1014 has a smooth interior surface, and the articulation joint knuckle 1012 has a smooth exterior surface, such that the articulation joint capsule 1014 and the foot rest 140 slidably articulate with respect to the articulation joint knuckle 1012 and the paddle shaft 1002.

Thus, the foot rest 140 can move with two degrees of freedom relative to the paddle shaft 1002. The three degrees of freedom are:

the forward-backward tilt angle of the foot rest 140 around the paddle shaft 1002, the side-to-side tilt angle of the foot rest 140 along the paddle shaft 1002, and clockwise/counterclockwise rotation of pedal 140 about the paddle shaft 1002.

Also shown is a splash guard collar 1020 configured to prevent water from a nearest paddle flowing along the paddle shaft 1002 from making contact with the two-axis articulation joint 142.

Figure 11:
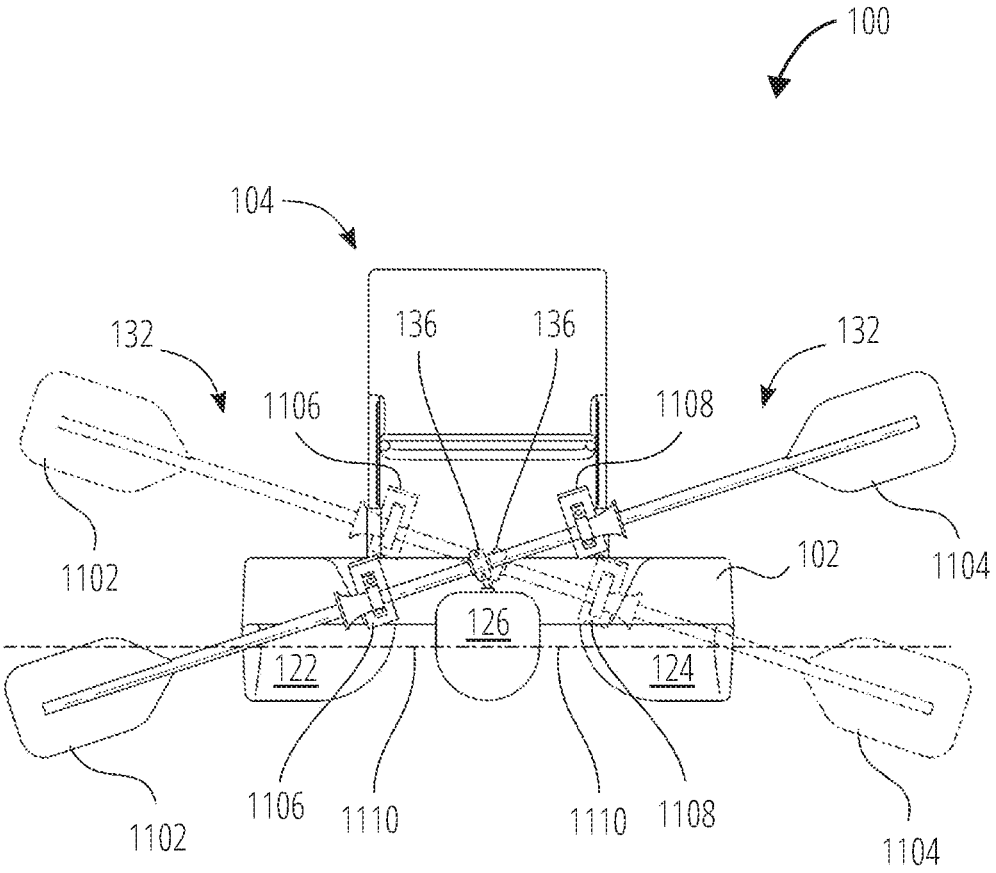
FIG. 11 is a front view of the tri-hull fishing kayak of FIG. 1A, showing some typical motions of the foot-operated paddle, alternately showing the pivot assembly tilting right as the right paddle is dipped into the water while the left paddle is above the water, and also showing the pivot assembly tilting left as the left paddle is dipped into the water while the right paddle is above the water.

With reference to FIG. 11, a front view of the embodiment of the tri-hull fishing kayak 100 of FIG. 1A is presented, showing typical motions of the foot-operated paddle 132 when paddling the tri-hull fishing kayak 100.

The pivot assembly 136 is pivotable to the right and to the left, being pivotable around the lower pivot bolt 1006 (shown in FIG. 10A) of the pivot assembly 136.

Shown in solid lines is the foot-operated paddle 132 in a position having the pivot assembly 136 tilted downward to the right, and having a right paddle 1102 below the water surface 1110 and a left paddle 1104 raised above the water surface 1110, corresponding to the user 602 (shown in FIG. 6) pressing the right foot 616 downward and lifting the left foot 616 upward to guide the right paddle 1102 below the water surface 1110.

Shown in dashed lines is the foot-operated paddle 132 in a position having the pivot assembly 136 tilted downward to the left, and having the left paddle 1104 below the water surface 1110 and the right paddle 1102 raised above the water surface 1110, corresponding to the user 602 (shown in FIG. 6) pressing the left foot 616 downward and the right foot 616 upward to guide the left paddle 1104 below the water surface 1110.

In this way, the user 602 powers the tri-hull fishing kayak 100 forward through the water by using their feet to alternately guide the right paddle 1102 below the water surface 1110 and simultaneously providing a backward stroke to the right paddle 1102, followed by the user 602 lifting the right paddle 1102 out of the water and guiding the left paddle 1104 below the water surface 1110 and simultaneously applying a backward stroke to the left paddle 1104.

Figure 12A:
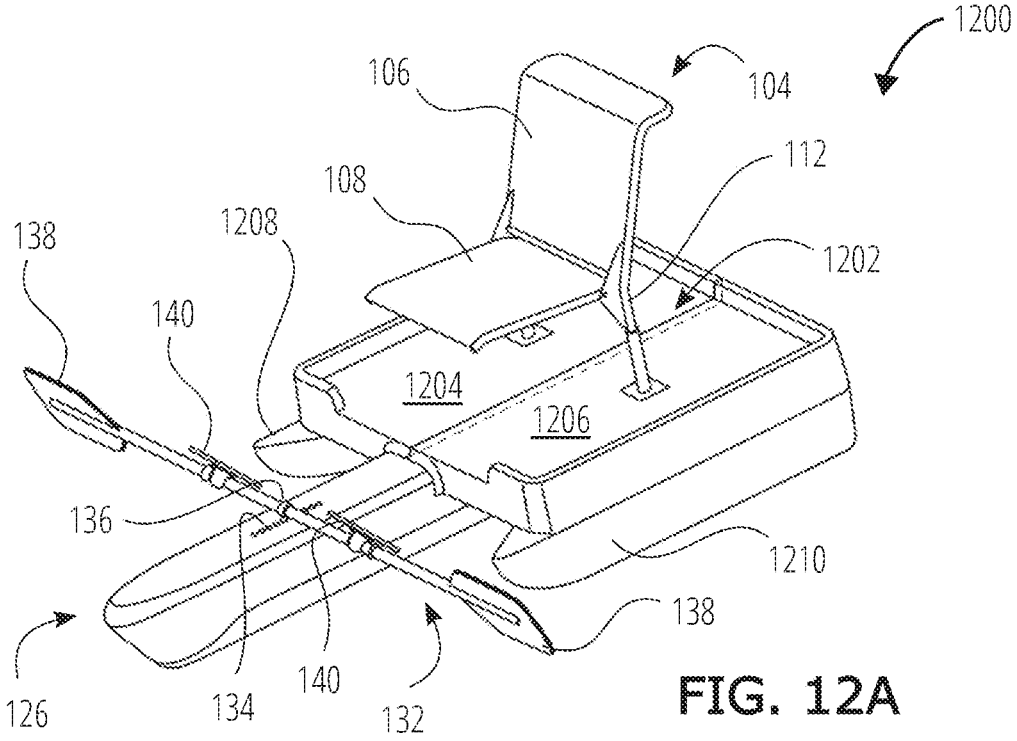
FIG. 12A is an isometric view of another embodiment of the tri-hull fishing kayak including a platform assembled from both a right half platform and a left half platform, the right side pontoon being integrally molded with the right half platform, the left side pontoon being integrally molded with the left half platform, and both the center pontoon and the seat being attached to the platform.

With reference to FIG. 12A, an isometric view of an embodiment 1200 of a tri-hull fishing kayak is shown, including a platform formed from a right half platform 1204 and a left half platform 1206. In this embodiment, the right side pontoon 1208 is in integrally molded relationship with the right half platform 1204, and the left side pontoon 1210 is in integrally molded relationship with the left half platform 1206. The forward central pontoon 126 is attached to the platform 1202 formed from the right half platform 1204 and the left half platform 1206.

Figure 12B:
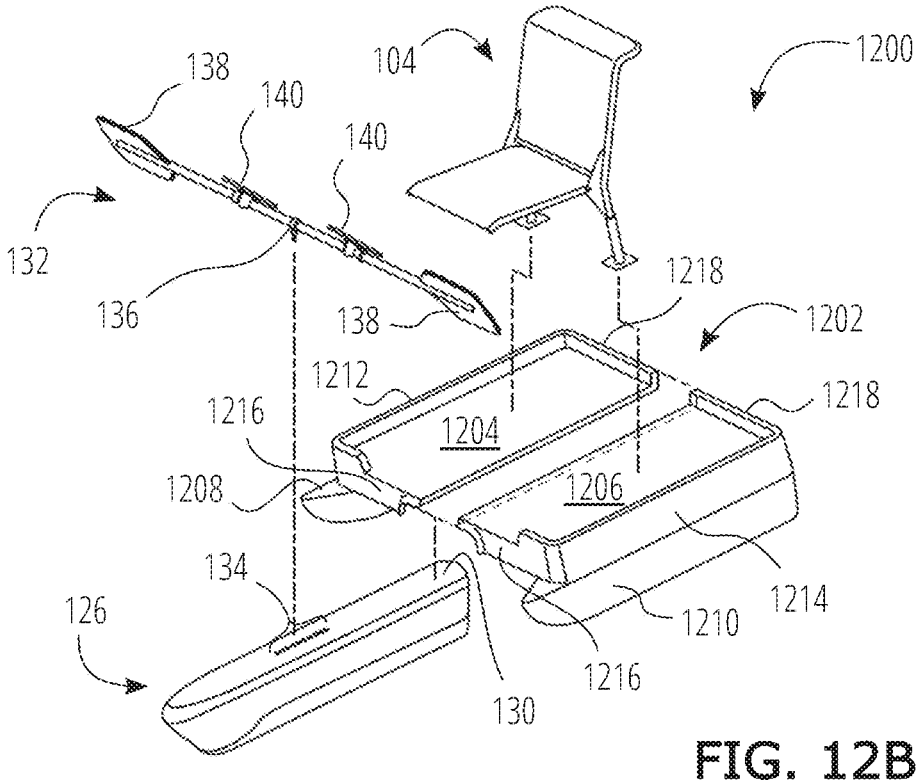
FIG. 12B is an exploded isometric view of the embodiment of FIG. 12A, showing the integrally molded right half platform and right side pontoon, the integrally molded left half platform and left side pontoon, the attachable seat, the attachable forward central pontoon, and the foot-operated paddle.

With reference to FIG. 12B, an exploded view of the embodiment 1200 of the tri-hull fishing kayak is shown, showing separately the integrally molded right half platform 1204 and right side pontoon 1208, the integrally molded left half platform 1206 and left side pontoon 1210, the seat 104, the foot-operated paddle 132, and the forward central pontoon 126, before being assembled.

The right half platform 1204 and the left half platform 1206 are attachable to each other so as to provide an assembled platform 1202 (shown assembled in FIG. 12A). In addition, the seat 104 is attachable to the assembled platform 1202 (also shown assembled in FIG. 12A), and the forward central pontoon 126 is attachable to the assembled platform 1202.

The right side pontoon 1208 is configured to support the right side 1212 of the assembled platform 1202, and the left side pontoon 1210 is configured to support the left side 1214 of the assembled platform 1202. The rear portion 130 of the forward central pontoon 126 is configured to be attached to and to support both the right half platform 1204 and the left half platform 1206.

This embodiment also includes a mounting rail along a right side 1212. a left side 1214, a rear side 1218, and a partial mounting rail along the front side 1216.

Other modifications and implementations will occur to those skilled in the art without departing from the spirit and the scope of the invention as claimed. Accordingly, the above description is not intended to limit the invention, except as indicated in the following claims.

What is claimed is:

1. A tri-hull fishing kayak comprising:

a platform, the platform having a right side, a left side, a front side, and a rear side;

a seat, the seat including a seat back and a seat base, the seat being attachable to the platform;

a right side pontoon configured to support the right side of the platform, the right side pontoon being in integrally molded relationship with the platform;

a left side pontoon configured to support the left side of the platform, the left side pontoon being in integrally molded relationship with the platform; and a forward central pontoon having a front portion and a rear portion, the rear portion configured to support the front side of the platform, the front portion extending forward from the front side of the platform, and the front portion having a plurality of locations configured to support a pivot assembly, the rear portion being in integrally molded relationship with the platform;

a foot-operated paddle having a pair of paddles and a pair of foot rests; and a pivot assembly, the pivot assembly configured to pivotably support the foot-operated paddle, the pivot assembly being attachable at one of the plurality of locations of the front portion.

2. The tri-hull fishing kayak of claim 1, wherein each foot rest of the pair of foot rests includes a three-axis articulation joint attached to the foot rest, the three-axis articulation joint being configured to ergonomically support a foot throughout an entire cycle of operation of the foot-operated paddle.

3. The tri-hull fishing kayak of claim 1, wherein the seat includes a plurality of seat height adjustment holes.

4. The tri-hull fishing kayak of claim 1, wherein the seat base is pivotable upward against the seat back so as to enable a user to stand on the platform.

5. The tri-hull fishing kayak of claim 1, wherein the platform is of a width between 36" to 49".

6. The tri-hull fishing kayak of claim 1, further comprising:

a right roller mounted under a trailing edge of the right side pontoon;

a left roller mounted under a trailing edge of the left side pontoon; and a handle mounted on a leading edge of the forward central pontoon, the handle being configured to lift the forward central pontoon, while the trailing edge of the right side pontoon and the trailing edge of the left side pontoon roll along on the right roller and the left roller respectively, for easy transportation over land.

7. The tri-hull fishing kayak of claim 1, wherein the platform includes:

at least one fishing rod holder reachable by a user sitting on the seat.

8. The tri-hull fishing kayak of claim 1, wherein the platform includes:

a storage compartment inside the platform.

9. The tri-hull fishing kayak of claim 1, wherein the platform includes:

a mounting rail along an edge of the platform.

10. The tri-hull fishing kayak of claim 1, further comprising:

a transom on a back top edge of the platform, the transom configured to mount an electric trolling motor.

11. The tri-hull fishing kayak of claim 1, wherein the platform includes:

a battery storage compartment under the seat.

12. A tri-hull fishing kayak comprising:

a platform, the platform having a right side, a left side, a front side, and a rear side;

a seat, the seat being in integrally molded relationship with the platform;

a right side pontoon configured to support the right side of the platform, the right side pontoon being in integrally molded relationship with the platform;

a left side pontoon configured to support the left side of the platform, the left side pontoon being in integrally molded relationship with the platform; and a forward central pontoon having a front portion and a rear portion, the rear portion configured to support the front side of the platform, the front portion extending forward from the front side of the platform, and the front portion having a plurality of locations configured to support a pivot assembly, the rear portion being in integrally molded relationship with the platform;

a foot-operated paddle having a pair of paddles and a pair of foot rests; and a pivot assembly, the pivot assembly configured to pivotably support the foot-operated paddle, the pivot assembly being attachable at one of the plurality of locations of the front portion.

13. The tri-hull fishing kayak of claim 12, wherein each foot rest of the pair of foot rests includes a three-axis articulation joint attached to the foot rest, the three-axis articulation joint being configured to ergonomically support a foot throughout an entire cycle of operation of the foot-operated paddle.

14. The tri-hull fishing kayak of claim 12, further comprising:

a right roller mounted under a trailing edge of the right side pontoon;

a left roller mounted under a trailing edge of the left side pontoon; and a handle mounted on a leading edge of the forward central pontoon, the handle being configured to lift the forward central pontoon, while the trailing edge of the right side pontoon and the trailing edge of the left side pontoon roll along on the right roller and the left roller respectively, for easy transportation over land.

15. A tri-hull fishing kayak comprising:

a platform, the platform having a right half platform and a left half platform, the right half platform being attachable to the left half platform so as to provide an assembled platform, the assembled platform having a right side, a left side, a front side, and a rear side;

a seat, the seat including a seat back and a seat base, the seat being attachable to the assembled platform;

a right side pontoon configured to support the right side of the assembled platform, the right side pontoon being in integrally molded relationship with the right half platform;

a left side pontoon configured to support the left side of the platform, the left side pontoon being in integrally molded relationship with the left half platform;

a forward central pontoon having a front portion and a rear portion, the rear portion configured to support the front side of the assembled platform, the front portion extending forward from the front side of the assembled platform, and the front portion having a plurality of locations configured to support a pivot assembly, the rear portion being attachable to both the right half platform and the left half platform;

a foot-operated paddle having a pair of paddles and a pair of foot rests; and a pivot assembly, the pivot assembly configured to pivotably support the foot-operated paddle, the pivot assembly being attachable at one of the plurality of locations of the front portion.

16. The tri-hull fishing kayak of claim 15, wherein each foot rest of the pair of foot rests includes a three-axis articulation joint attached to the foot rest, the three-axis articulation joint being configured to ergonomically support a foot throughout an entire cycle of operation of the foot-operated paddle.

17. The tri-hull fishing kayak of claim 15, further comprising:

a right roller mounted under a trailing edge of the right side pontoon;

a left roller mounted under a trailing edge of the left side pontoon; and a handle mounted on a leading edge of the forward central pontoon, the handle being configured to lift the forward central pontoon, while the trailing edge of the right side pontoon and the trailing edge of the left side pontoon roll along on the right roller and the left roller respectively, for easy transportation over land.

* * * * *